US005252443A

United States Patent [19]

Dickerson

[11] Patent Number: 5,252,443

[45] Date of Patent: Oct. 12, 1993

[54] MEANS FOR ASSURING PROPER ORIENTATION OF THE FILM IN AN ASYMMETRICAL RADIOGRAPHIC ASSEMBLY

[75] Inventor: Robert E. Dickerson, Rochester, N.Y.

[73] Assignee: Eastman Kodak Company, Rochester, N.Y.

[21] Appl. No.: 830,156

[22] Filed: Feb. 3, 1992

[51] Int. Cl.[5] ..... G03C 1/46

[52] U.S. Cl. ..... 430/502; 430/508; 430/509; 430/513; 430/522; 430/606; 430/139; 430/966

[58] Field of Search ..... 430/502, 508, 509, 513, 430/522, 606, 139, 966

[56] References Cited

U.S. PATENT DOCUMENTS

| | | | |
|---|---|---|---|
| H1,105 | 9/1992 | Jebo et al. . | |
| 3,932,188 | 1/1976 | Tanaka et al. | 430/522 |
| 4,425,425 | 1/1984 | Abbott et al. | 430/502 |
| 4,425,426 | 1/1984 | Abbott et al. | 430/502 |
| 4,707,435 | 11/1987 | Lyons et al. | 430/494 |
| 4,710,637 | 12/1987 | Luckey et al. | 250/486.1 |
| 4,803,150 | 2/1989 | Dickerson et al. | 430/502 |
| 4,877,721 | 10/1989 | Diehl et al. | 430/522 |
| 4,900,652 | 2/1990 | Dickerson et al. | 430/502 |
| 4,994,355 | 2/1991 | Dickerson et al. | 430/509 |
| 4,997,750 | 3/1991 | Dickerson et al. | 430/509 |
| 5,021,327 | 6/1991 | Bunch et al. | 430/502 |
| 5,108,881 | 4/1992 | Dickerson et al. | 430/502 |

OTHER PUBLICATIONS

Research Disclosure, Item 18431, Aug., 1979, pp. 433-440.

Rossman and Sanderson, "Validity of the Modulation Transfer Function of Radiographic Screen-Film Systems Measured by the Slit Method", Phys. Med. Biol., vol. 13, pp. 259-268.

*Primary Examiner*—Charles L. Bowers, Jr.
*Assistant Examiner*—Thomas R. Neville
*Attorney, Agent, or Firm*—Carl O. Thomas

[57] ABSTRACT

An asymmetrical radiographic element is disclosed comprised of a transparent film support, green sensitized silver halide emulsion layer units of differing sensitometric characteristics coated on opposite sides of the film support, and a processing solution decolorizable means for reducing crossover to less than 10 percent. The element is positioned between intensifying screens and mounted in a cassette for exposure to X-radiation. A processing solution decolorizable pentamethineoxonol dye with insignificant absorption at 550 nm is incorporated into an overcoat layer to distinguish which of the emulsion layer units is positioned nearest a source of X-radiation during exposure.

10 Claims, 1 Drawing Sheet

MEANS FOR ASSURING PROPER ORIENTATION OF THE FILM IN AN ASYMMETRICAL RADIOGRAPHIC ASSEMBLY

FIELD OF THE INVENTION

The invention relates to low crossover, double coated radiographic elements with different emulsions on the opposite side of the support and an incorporated means to determine their orientation in handling.

BACKGROUND

In medical radiography an image of a patient's tissue and bone structure is produced by exposing the patient to X-radiation and recording the pattern of penetrating X-radiation using a radiographic element containing at least one radiation-sensitive silver halide emulsion layer coated on a transparent (usually blue tinted) film support. The X-radiation can be directly recorded by the emulsion layer where only limited areas of exposure are required, as in dental imaging and the imaging of body extremities. However, a more efficient approach, which greatly reduces X-radiation exposures, is to employ an intensifying screen in combination with the radiographic element. The intensifying screen absorbs X-radiation and emits longer wavelength electromagnetic radiation which silver halide emulsions more readily absorb. Another technique for reducing patient exposure is to coat two silver halide emulsion layers on opposite sides of the film support to form a "double coated" radiographic element.

Diagnostic needs can be satisfied at the lowest patient X-radiation exposure levels by employing a double coated radiographic element in combination with a pair of intensifying screens. The silver halide emulsion layer unit on each side of the support directly absorbs about 1 to 2 percent of incident X-radiation. The front screen, the screen nearest the X-radiation source, absorbs a much higher percentage of X-radiation, but still transmits sufficient X-radiation to expose the back screen, the screen farthest from the X-radiation source. In the overwhelming majority of application the front and back screens are balanced so that each absorbs about the same proportion of the total X-radiation. However a few variations have been reported from time to time. A specific example of balancing front and back screens to maximize image sharpness is provided by Luckey, et al., U.S. Pat. No. 4,710,637. Lyons et al. U.S. Pat. No. 4,707,435 discloses in Example 10 the combination of two proprietary screens, Trimax 2TM employed as the front screen and Trimax 12FTM employed as a back screen. Rossman and Sanderson, "Validity of the Modulation Transfer Function of Radiographic Screen-Film Systems Measured by the Slit Method", Phys. Med. Biol., 1968, vol. 13, pp. 259–268, report the use of unsymmetrical screenfilm assemblies in which either the two screens had measurably different optical characteristics or the two emulsions had measurably different optical properties.

An imagewise exposed double coated radiographic element contains a latent image in each of the two silver halide emulsion units on opposite sides of the film support. Processing converts the latent images to silver images and concurrently fixes out undeveloped silver halide, rendering the film light insensitive and transparent. When the film is mounted on an illuminated viewer, the two superimposed silver images on opposite sides of the transparent support are seen as a single image. against a white, illuminated background.

An art recognized difficulty with employing double coated radiographic elements in combination with intensifying screens as described above is that some light emitted by each screen passes through the transparent film support to expose the silver halide emulsion layer unit on the opposite side of the support to light. The light emitted by a screen that exposes the emulsion layer unit on the opposite side of the support reduces image sharpness. The effect is referred to in the art as crossover.

The most successful approach to crossover reduction yet realized by the art, consistent with viewing the superimposed silver images through a transparent film support without manual registration of images, has been to employ double-coated radiographic elements containing spectrally sensitized tabular grain emulsions of high aspect ratio or intermediate aspect ratio, illustrated by Abbott et al. U.S. Pat. Nos. 4,425,425 and 4,425,426, respectively. Whereas radiographic elements prior to Abbott et al. typically exhibited crossover levels of at least 25 per cent, Abbott et al. provide examples of crossover reductions in the 15 to 22 per cent range.

More recently, Dickerson et al. U.S. Pat. No. 4,803,150 demonstrated that by combining the teachings of Abbott et al. with a processing solution decolorizable microcrystalline dye located between at least one of the emulsion layer units and the transparent film support, "zero" crossover levels can be realized. Dickerson et al. U.S. Pat. No. 4,900,652 adds to these teachings a specific selection of hydrophilic colloid coating coverages in the emulsion and dye containing layers to allow the "zero" crossover radiographic elements to emerge dry to the touch from a conventional rapid access processor in less than 90 seconds with the crossover reducing microcrystalline dye decolorized.

By minimizing the effects of crossover it became feasible to prepare double coated elements in which the emulsions on the opposite sides of the support have different sensitometry. Dickerson and Bunch U.S. Pat. Nos. 4,994,355 and 4,997,750 disclosed "zero" crossover, double coated radiographic elements in which the emulsion layer units on opposite sides of the support differ, respectively, in contrast and in speed. Dickerson and Bunch U.S. Ser. No.502,153, filed Mar. 29, 1990, now U.S. Pat. No. 5,108,881, disclosed zero crossover double coated radiographic elements in which the emulsion layer units on opposite sides of the support differ in contrast in a manner particularly suited to permitting flexibility in the choice of intensifying screen pairs employed.

Bunch and Dickerson U.S. Pat. No. 5,021,327 disclosed zero crossover double coated radiographic elements in combination with a pair of intensifying screens, where the combination of the back emulsion layer unit and its intensifying screen exhibits a photicity twice that of the combination of the front emulsion layer unit and its intensifying screen, where photicity is the product of screen emission and emulsion layer unit sensitivity. All of the elements just described can be referred to as sensitometrically asymmetrical.

These combinations of asymmetrically coated radiographic elements used with different screens present a practical problem with their use in the darkrooms of typical radiological laboratories. In practice, for each radiograph taken of a patient, the film, i.e., the photographic element, is typically removed from a package in darkness or under dim, dark red safelights and loaded into a hinged, light-tight cassette. The screens are mounted on the inside of the two hinged sides of the cassette so that they are positioned in close contact with the inserted film when the cassette is closed. When an asymmetrically coated film is used in a cassette with two different screens, the film must be oriented in the proper position in order to achieve the desired sensitometry. Since the film looks identical on both sides under the dim lighting conditions of the darkroom, the technician has no certain way of determining which side of the film should eventually face the source of the X-radiation unless it is marked is some way. The front of the closed cassette is loaded into the exposure device with a labeled side facing the X-ray source. After the radiograph is taken, the film is removed from the cassette for processing and the cassette is reloaded for another radiograph.

Jebo et al., U.S. Ser. No. 502,341, filed Mar. 29, 1990, now Statutory Invention Registration H1105, described various orienting means, all mechanical or electrical in nature, for properly positioning an asymmetric radiographic element into the cassette. The means described all involved designing the cassette and film assembly in such a way that the film will only fit in the cassette in a single orientation. The means also involved marking the film and/or the screens so that they can be aligned in an obvious way while loading under dark or safelight conditions. They relied on means such as corner cuts, corner marks, and dimples in the film, alignment of holes for insertion of a pin, and of electrical contacts, etc., to prevent misalignment of the asymmetric film in the cassette.

SUMMARY OF THE INVENTION

This invention is directed to a radiographic element comprised of a transparent film support, first and second tabular grain silver halide emulsion layer units coated on opposite sides of the film support and spectrally sensitized with at least one dye having an absorption peak in the green portion of the spectrum, means for reducing to less than 10 per cent crossover of electromagnetic radiation of wavelengths longer than 300 nm capable of forming a latent image in the silver halide emulsion layer units, said first and second silver halide emulsion layer units exhibiting significantly different sensitometric characteristics, and orienting means for ascertaining which of said first and second emulsion layer units are positioned nearest a source of X-radiation during exposure; characterized in that said orienting means is comprised of an overcoat layer overlying one of said emulsion layer units containing a red-absorbing, processing solution decolorizable pentamethineoxonol dye having bis(2-pyrazolin-5-one) nuclei, substituted with (a) acyl groups in the 3- and 3'-positions, (b) aryl groups in the 1- and 1'-positions, and (c) bearing from 4 to 6 acidic substituents each of which are capable of forming a monovalent anion provided that at least two of such substituents are other than carboxyl.

DETAILED DESCRIPTION OF THE INVENTION

Figure 1:
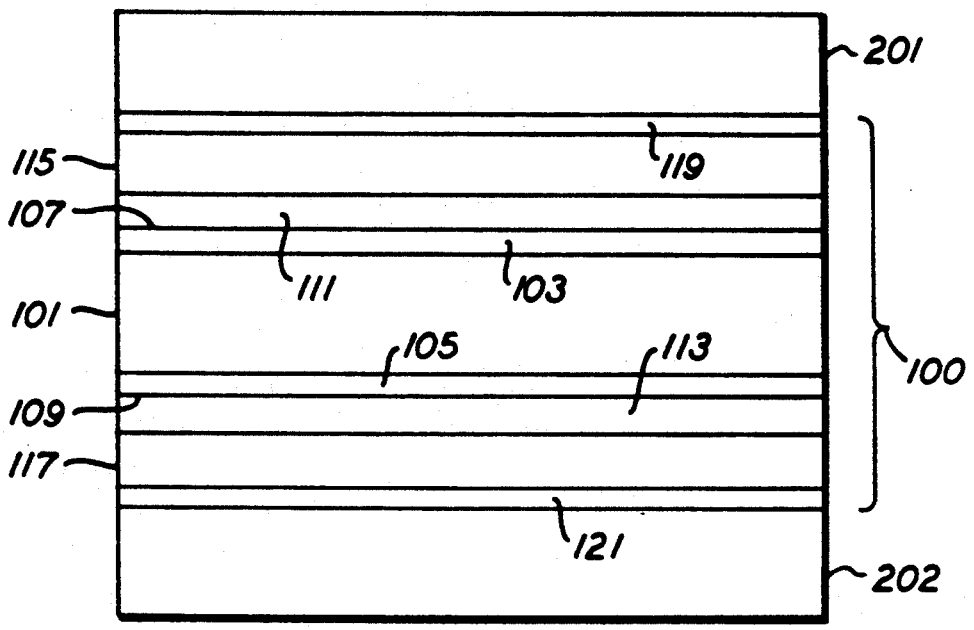
FIG. 1 is a schematic diagram of an assembly consisting of a double coated radiographic element sandwiched between two intensifying screens.

The double coated radiographic elements of this invention offer the capability of producing superimposed silver images capable of transmission viewing which can satisfy the highest standards of the art in terms of speed and sharpness. At the same time they re more adaptable to meeting the varied imaging demands of medical diagnostic radiology and in specific applications are capable of producing superior imaging results. For example, the radiographic elements can be selected to produce a wide range of contrasts merely by altering the choice of intensifying screens employed in combination with the radiographic elements. Further, they can produce superior imaging detail over a wide range of exposure levels within a single image, such as is required for successfully capturing both heart and lung image detail within a single radiographic image. The radiographic elements are constructed with a transparent film support and first and second emulsion layer units coated on opposite sides of the support. This allows transmission viewing of the silver images on opposite sides of the support after exposure and processing.

Between the emulsion layer units on opposite sides of the support, means are provided for reducing to less than 10 percent crossover of electromagnetic radiation of wavelengths longer than 300 nm capable of forming a latent image in the silver halide emulsion layer units. In addition to having the capability of absorbing longer wavelength radiation during imagewise exposure of the emulsion layer units the crossover reducing means must also have the capability of being decolorized in less than 90 seconds during processing, so that no visual hindrance is presented to viewing the superimposed silver images.

The crossover reducing means decreases crossover to less than 10 percent, preferably reduces crossover to less than 5 percent, and optimally less than 3 percent. However, it must be kept in mind that for crossover measurement convenience the crossover percent being referred to also includes "false crossover", apparent crossover that is actually the product of direct X-radiation absorption. That is, even when crossover of longer wavelength radiation is entirely eliminated, measured crossover will still be in the range of 1 to 2 percent, attributable to the X-radiation that is directly absorbed by the emulsion farthest from the intensifying screen. Crossover percentages are determined by the procedures set forth in Abbott et al. U.S. Pat. Nos. 4,425,425 and 4,425,426. Once the exposure crossover between the emulsion layer units has been reduced to less than 10 percent (hereinafter referred to as low crossover) the exposure response of an emulsion layer unit on one side of the support is influenced to only a slight extent by (i.e., essentially independent of) the level of exposure of the emulsion layer on the opposite side of the support. It is therefore possible to form two independent imaging records, one emulsion layer unit recording only the emission of the front intensifying screen and the remaining emulsion layer recording only the emission of the back intensifying screen during imagewise exposure to X-radiation.

Historically radiographic elements have been constructed to produce identical sensitometric records in the two emulsion layer units on the opposite sides of the support. The reason for this is that until practical low crossover radiographic elements were made available by Dickerson et al. U.S. Pat. Nos. 4,803,150 and 4,900,652, cited above, both emulsion layer units of a double coated radiographic element received essentially similar exposures, since both emulsion layer units were simultaneously exposed by both the front and back intensifying screens. Even with the recent introduction of practical low crossover radiographic elements the practice of coating identical emulsion layer units on opposite sides of the support has continued.

The radiographic elements of this invention employ emulsion layer units on opposite sides of the transparent support that differ in their sensitometric properties. That is, not only are the radiographic records produced in each of the emulsion layer units independent of the other, but the emulsion layer units also are selected to have differing imaging properties. Stated another way, the radiographic elements are sensitometrically asymmetrical. It is this feature that allows the radiographic elements of this invention to exhibit the greater adaptability and improvement of imaging properties noted above.

Customarily, sensitometric characterizations of double coated radiographic elements generate characteristic (density vs. log exposure) curves that are the sum of two identical emulsion layer units, one coated on each of the two sides of the transparent support. Therefore, to keep speed and other sensitometric measurements (minimum density, contrast, maximum density, etc.) as compatible with customary practices as possible, the speed and other sensitometric characteristics of the first silver halide emulsion unit are determined with the first silver halide emulsion unit replacing the second silver halide emulsion unit to provide an arrangement with the first silver halide emulsion unit present on both sides of the transparent support. The speed and other sensitometric characteristics of the second silver halide emulsion unit replacing the first silver halide emulsion unit to provide an arrangement with the second silver halide emulsion unit present on both sides of the transparent support.

The sensitometric differences between the first and second emulsion layer units can be varied to achieve a wide variety of different imaging effects. The advantages can best be illustrated by considering first and second emulsion layer units on opposite sides of the support that differ in speed and/or in contrast.

In one preferred form, the first silver halide emulsion layer unit exhibits a speed at 1.0 above minimum density which is at least twice that of the second silver halide emulsion layer unit. While the best choice of speed differences between the first and second emulsion layer units can differ widely, depending upon the contrast of each individual emulsion and the application to be served, in most instances the first emulsion layer unit will exhibit a speed that is from 2 to 10 times that of the second emulsion layer unit. In most applications optimum results are obtained when the first emulsion layer unit exhibits a speed that is from about 2 to 4 times that of the second emulsion layer unit. So long as the relative speed relationships are satisfied, the first and second emulsion units can cover the full range of useful radiographic imaging speeds. For purposes of ascertaining speed differences speed is measured at 1.0 above minimum density. It is recognized that this is an arbitrary selection point, chosen simply because it is typical of speed measurements in radiography. For nontypical characteristic curves (e.g., direct positive imaging or unusual curve shapes) another speed reference point can be selected.

The advantage gained by employing emulsion layer units differing in speed as noted above is that by employing differing intensifying screens with these radiographic elements a wide range of differing image contrasts can be obtained using a single type of radiographic element. It is, for example, possible to employ a single type of radiographic element according to this invention in combination with each of two pairs of intensifying screens in which the emission characteristics of the front and back screens differ (hereinafter referred to as an unsymmetrical screen pair). When one unsymmetrical screen pair has an emission pattern that is the reverse of another—i.e., the front and back screen emissions match the back and front screen emission of the other pair, two different images differing in contrast are obtained. By using several different symmetrical or unsymmetrical pairs of intensifying screens a variety of image contrasts can be achieved with a single type of radiographic element according to this invention under identical X-radiation exposure conditions. When conventional symmetrical low crossover double coated radiographic elements or high crossover radiographic elements, regardless of whether the emulsion layer units are the same or different, are substituted for the radiographic elements of this invention, reversing emission characteristics of unsymmetrical front and back screen pairs has little or no effect on image contrast. It is specifically contemplated to obtain two different images of differing contrast using only one type of sensitometrically asymmetrical low crossover radiographic element according to the invention merely by reversing the orientation of the radiographic element between the intensifying screens.

In another preferred form of the invention the first and second emulsion layer units differ significantly in contrast. In one specifically preferred form, the first silver halide emulsion layer unit exhibits an average contrast of less than 2.0 while the second silver halide emulsion layer unit exhibits an average contrast of at least 2.5. It is preferred that the average contrasts of the first and second silver halide emulsion layer units differ by at least 1.0 While the best choice of average contrast differences between the first and second emulsion layer units can differ widely, depending upon the application to be served, in most instances the first and second emulsion layer units exhibit an average contrast difference in the range of from 0.5 to 1.0, optimally from 1.0 to 1.5, where a conventional uniform intensity source of X-radiation is employed for exposure.

By employing advanced multiple-beam equalization radiography (AMBER) the average contrast differences between the first and second emulsion layer units can be increased, so that average contrast differences between the first and second emulsion layer units can be increased, so that average contrast differences in the range of from 0.5 to 3.5, optimally from 1.0 to 2.5 can be employed. These wider ranges of average contrast differences are made possible because of the capability of the AMBER exposure system to sense and reduce exposure in areas of the radiographic element that would otherwise receive a maximum X-radiation exposure—e.g., lung areas. Thus the AMBER exposure system is, for example, capable of concurrently providing useful heart and lung area imaging detail even though the second emulsion layer unit exhibits higher contrast levels than would normally be used with conventional uniform X-radiation exposure systems employed for heart and lung area imaging. A description of the AMBER exposure system is provided by Schultze-Kool, Busscher, Vlasbloem, Hermans, van der Merwe, Algra and Herstel, "Advanced Multiple-Beam Equalization Radiography in Chest Radiography: A Stimulated Nodule Detection Study", Radiology, October 1988, pp. 35–39, here incorporated by reference.

As employed herein the term "average contrast" is employed to indicate a contrast determined by reference to an emulsion layer unit characteristic curve at a density of 0.25 above minimum density and at a density of 2.0 above minimum density. The average contrast is the density difference, 1.75, divided by the log of the difference in exposure levels at two density reference points on the characteristic curve, where the exposure levels are meter-candle-seconds. As in the case of the speed determinations above, the reference points for average contrast determinations have been arbitrarily selected from among typical reference points employed in radiography. For nontypical characteristic curves (e.g., direct positive imaging or unusual curve shapes) other referenced densities can be selected.

It is possible to obtain better imaging detail in both high density (e.g., heart) and low density (e.g., lung) image areas when the contrasts of the first and second emulsion layer units differ as described above. It is of course, possible to employ first and second emulsion layer units that differ in both speed and contrast.

Since the emulsion layer units of the radiographic element are sensitometrically different and produce a different radiographic image depending upon which of the two unlike emulsion layer units is positioned nearest the source of X-radiation during imagewise exposure, it is necessary to incorporate means for ascertaining which of the emulsion layer units is positioned nearest the source of X-radiation during exposure. When the front and back intensifying screens differ significantly in their emission characteristics, very large imaging differences are created by reversing the sensitometrically asymmetric radiographic elements of this invention in relation to the intensifying screens.

This invention is directed to orienting means for ascertaining which of said first and second emulsion layer units are to be positioned toward the source of X-radiation during exposure. The orienting means comprises an overcoat layer containing a redabsorbing dye on one side of the asymmetrical double coated element. In the presence of the dark red safelights commonly used in the darkrooms of facilities used for medical radiography, the dyed overcoat layer allows a dark room technician loading the film into a cassette containing the fluorescent intensifying screens to readily distinguish visually the front side of the film, that is, the side facing the exposure source, from the back side in order to avoid reversing the asymmetrical element with respect to the exposure source and the intensifying screens. For example, the red-dyed overcoat layer can be located on the front side of the film. Under the dark red safelights, the front side of the film containing the red-dyed layer would appear black in contrast to the undyed emulsion side which would be a much lighter gray in appearance.

The red-absorbing dye in the overcoat layer must have an absorption spectrum that does not have any significant absorption in the region of green sensitivity of the emulsions. It must also be completely removed on processing and preferably not be retained to stain the processing solution. Any absorption of light by the dye in area of the green sensitivity region of the green-sensitized film would reduce the film speed of the emulsion underlying the dyed overcoat layer and would upset the sensitometric balance of the combination of emulsions to achieve the desired end result.

Preferred dyes to fulfill these requirements as the orienting means in an overcoat layer as described above are red-absorbing, processing solution decolorizable pentamethineoxonol dyes having bis(2-pyrazolin-5-one) nuclei substituted with (a) acyl groups in the 3- and 3'-positions, (b) aryl groups in the 1- and 1'-positions, and (c) bearing from 4 to 6 acidic substituents, each of which are capable of forming a monovalent anion, provided that at least two of such substituents are other than carboxyl.

The dyes of the invention have the structure,

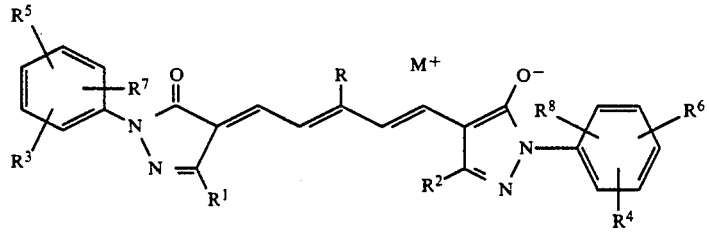

wherein

R is hydrogen or a lower alkyl of up to 4 carbon atoms;

R1 and R2 represent an aliphatic or alicyclic acyl group such as acetyl, propionyl, octanoyl, cyclopropanecarbonyl, benzoyl, etc.;

R3, R4, R5, R6, R7, and R8 each represent hydrogen or an acidic substituent capable of forming an anion such as carboxyl, sulfo, sulfato, thiosulfato, etc., provided that a) at least four of R3, R4, R5, R6, R7, and R8 must be acidic substituents and b) at least two of such acidic groups are other than carboxy; and M30 represents hydrogen or a monovalent cation.

The dyes have absorption maxima generally above 650 nm with high extinction at the maximum and narrow absorption envelopes which tail off sharply on the low wavelength side above 550 nm so that there is no significant absorption at 550 nm, the peak of the spectral sensitivity of the emulsions sensitized to utilize the high emission of the green-emitting phosphors, in particular the preferred terbium-activated gadolinium oxysulfide phosphors employed in the intensifying screens. The attributes of these pentamethineoxonol dyes are imparted especially by the 1-aryl and the 3-acyl groups. The acidic substituents impart water solubility which contributes to the ease of dye removal during processing. The preparation of the dyes is described by Diehl and Reed, U.S. Pat. No. 4,877,721.

The spectral sensitizers can be any dyes that impart high sensitivity to the radiographic emulsions at the wavelengths that the green-emitting phosphors have their strongest emission. The preferred sensitizers having sensitivity maxima in the region of 550 nm are 5,5'-substituted-3,3'-bis(sulfoalkyl)-substituted oxacarbocyanines.

It is conventional practice to protect the emulsion layers as described above from damage by providing clear overcoat layers. These overcoat layers can be formed of the same vehicles and vehicle extenders as used in the emulsion layers. They are most commonly gelatin or a gelatin derivative. Single dyes or mixtures of dyes can be employed, provided that they can be completely removed on processing. The pentamethineoxonol dye or combination of dyes are generally incorporated into the overcoat layer at a level ranging from 5 to 200 mg/m$^2$, preferably from 10 to 60 mg/$^2$.

Examples of the dyes employed in the overcoat layers of the invention are:

Dye 1

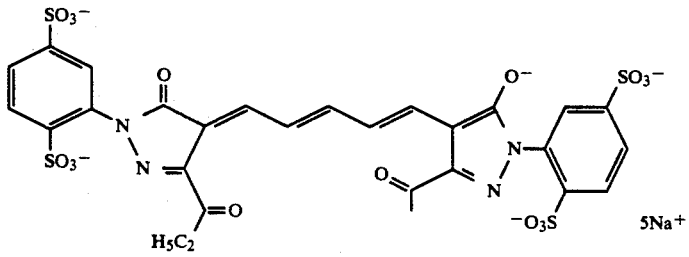

Dye 2

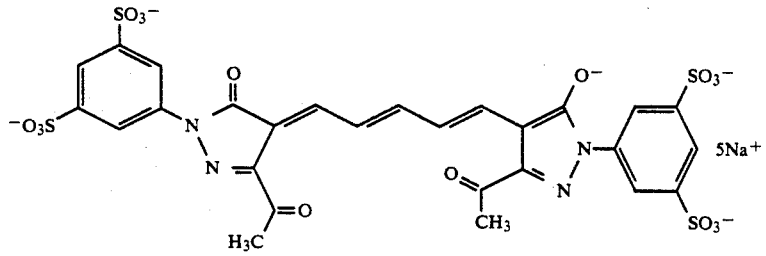

Dye 3

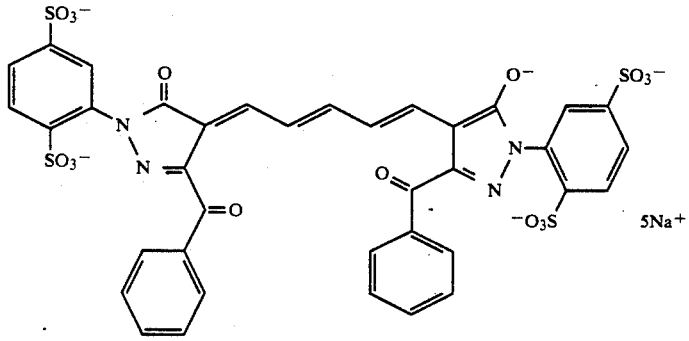

Dye 4

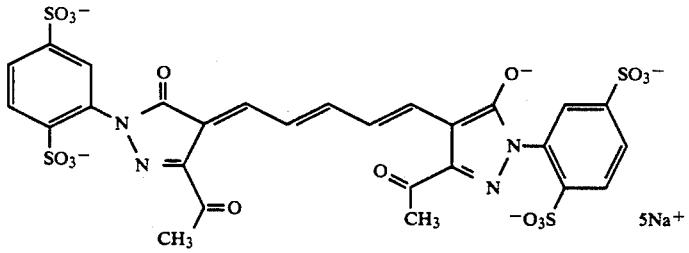

Dye 5

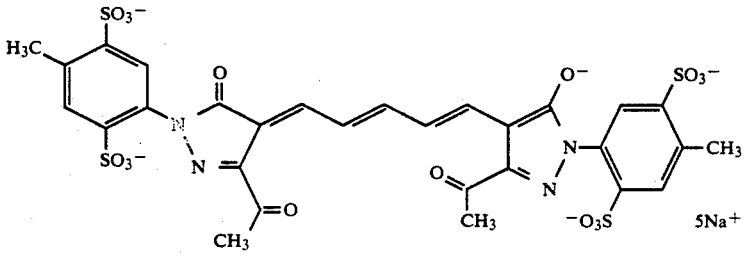

-continued

Dye 6

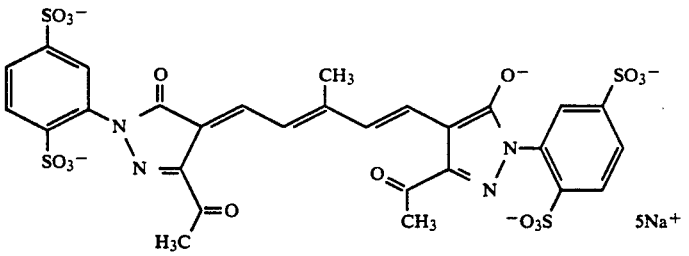

Dye 7

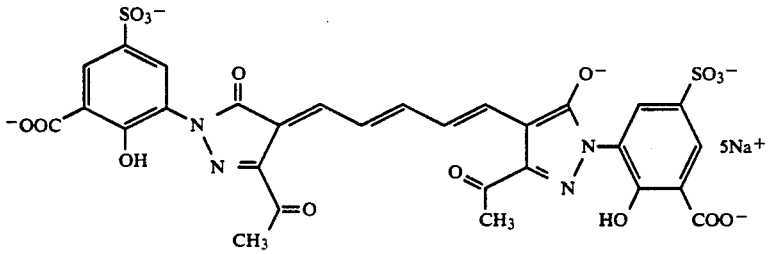

Dye 8

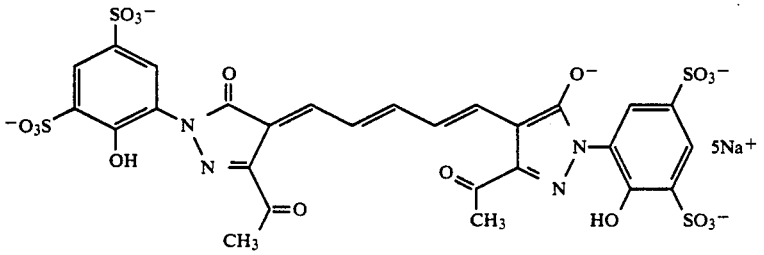

Dye 9

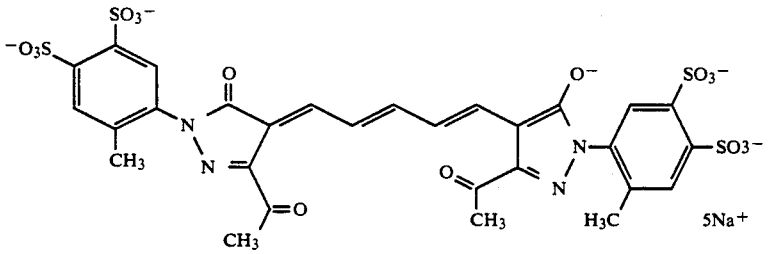

Dye 10

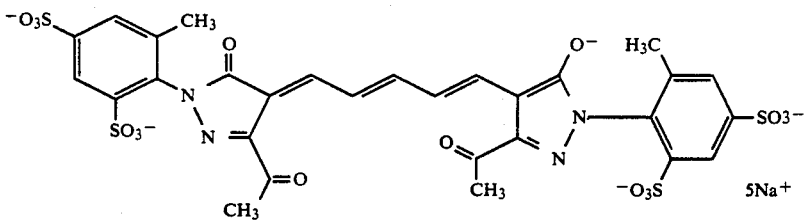

The most important advantage of the invention is to the patient of whom the radiograph is taken. Most of all it prevents mistakes of reversing the film when loading it into the cassettes for exposure and thereby minimizes the need for retakes and further exposure of the patient to X-rays. The second advantage is in the cost savings and convenience in manufacturing of incorporating the orienting means within the element, into an overcoat layer which already is present, but only as a protective layer over the silver halide emulsion. It avoids entirely the need to provide for additional mechanical or electrical means of cutting, slitting, punching holes, or incorporating electrical contacts into the film and also the need to produce special asymmetrical cassettes into which the film can only fit in one position.

The structural features of the invention can best be appreciated by reference to FIG. 1. The assembly shows a radiographic element 100 according to this invention positioned between a pair of light emitting intensifying screens 201 and 202. The radiographic element is comprised of a transparent radiographic support 101, typically blue tinted, capable of transmitting light to which it is exposed and optionally, similarly transmissive subbing layer units 103 and 105. On the first and second opposed major faces 107 and 109 of the support formed by the underlayer units are crossover reducing hydrophilic colloid layers 111 and 113, respectively.

Overlying the crossover reducing layers 111 and 113 are the light recording latent image forming silver halide emulsion layer units 115 and 117, respectively, that differ from each other. Each of the emulsion layer units is formed of one or more hydrophilic colloid layers including at least one silver halide emulsion layer. Overlying the emulsion layer units 115 and 117 are hydrophilic colloid protective overcoat layer 119 and 121, respectively, either one of which, but only one, contains the red-absorbing dye of the invention. All of the hydrophilic colloid layers are permeable to processing solutions.

In use the assembly is imagewise exposed to X-radiation. The X-radiation is principally absorbed by the intensifying screens 201 and 202, which promptly emit light as a direct function of X-ray exposure. Considering first the light emitted by screen 201, the light recording latent image forming emulsion layer unit 115 is positioned adjacent this screen to receive the light which it emits. Because of the proximity of the screen 201 to the emulsion layer unit 115, only minimal light scattering occurs before latent image forming absorption occurs in this layer unit. Hence light emission from screen 201 forms a sharp image in emulsion layer unit 115. However, not all of the light emitted by screen 201 is absorbed within emulsion layer unit 115. This remaining light, unless otherwise absorbed, will reach the remote emulsion layer unit 117 resulting in a highly unsharp image being formed in this remote emulsion layer unit. Both crossover reducing layers 111 and 113 are interposed between the screen 201 and the remote emulsion layer unit and are capable of intercepting and attenuating this remaining light. Both of these layers thereby contribute to reducing crossover exposure of the emulsion layer unit 117 by the screen 201. In an exactly analogous manner the screen 202 produces a sharp image in emulsion layer unit 117, and the light absorbing layers 111 and 113 similarly reduce crossover exposure of the emulsion layer unit 115 by the screen 202.

Following exposure to produce a stored latent image, the radiographic element 100 is removed from association with the intensifying screens 201 and 202 and processed in a rapid access processor—that is, a processor such as an RP-X-OmatTM processor, which is capable of producing an image bearing radiographic element dry to the touch in less than 90 seconds. Rapid access processors are illustrated by Barnes et al. U.S. Pat. No. 3,545,971 and Akio et al. European published patent application 248,390. Since rapid access processors employed commercially vary in their specific processing cycles and selections of processing solutions, the preferred radiographic elements satisfying the requirements of the present invention are specifically identified as being those that are dried to the touch when processed in 90 seconds according to the following reference conditions:

| | |
|---|---|
| Development | 24 seconds at 35° C., |
| Fixing | 20 seconds at 35° C., |
| Washing | 10 seconds at 35° C., |
| Drying | 20 seconds at 65° C., |

where the remaining time is taken up in transport between processing steps. The development step employs the following developer:

| | |
|---|---|
| Hydroquinone | 30. g |
| 1-Phenyl-3-pyrazolidone | 1.5 g |
| KOH | 21. g |
| NaHCO3 | 7.5 g |
| K2SO3 | 44.2 g |
| Na2S2O5 | 12.6 g |
| NaBr | 35. g |
| 5-Methylbenzotriazole | 0.06 g |
| Glutaraldehyde | 4.9 g |
| Water to 1 liter at pH 10.0, | |

and the fixing step employs the following fixing composition:

| | |
|---|---|
| Ammonium thiosulfate, 60% | 260. g |
| Sodium bisulfite | 180. g |
| Boric acid | 25. g |
| Acetic acid | 10. g |
| Aluminum sulfate | 8. g |
| Water to 1 liter at pH 3.9–4.5. | |

In one embodiment of the invention screen 201 is a high resolution, fine particle screen and screen 202 is the regular, lower resolution screen conventionally used in radiography. These are mounted into the two sides of a light-tight cassette so that the support side of the screen 201 will face the source of X-radiation during the exposure and the screen surfaces 201 and 202 are in contact with the radiographic element. In the element emulsion layer 115 is a high contrast tabular grain emulsion and emulsion layer 117 is a tabular grain emulsion of substantially lower contrast. Overcoat layer 119 contains the incorporated red-absorbing dye of the invention and signifies to the technician loading the film that it should face the high resolution screen 201.

EXAMPLES

The invention can be better appreciated by reference to the following examples:

Radiographic Elements

Asymmetrically double-coated radiographic elements A through F exhibited near zero crossover and are identical except for the level of dye coated in the overcoat layer. The emulsions on the opposite sides of each element differ in contrast.

Radiographic element A was constructed of a low crossover support composite consisting of a subbed, blue-tinted transparent polyester film support coated on each side with a crossover reducing layer consisting of gelatin (1.6 g/m2) containing 215 mg/m2 of a particulate dispersion of Dye A.

Dye A

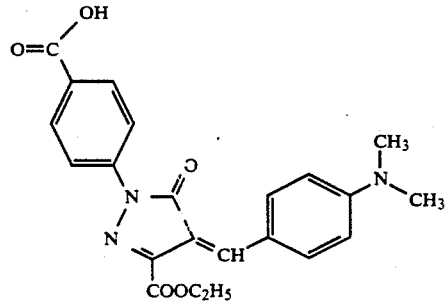

Low contrast and high contrast emulsion layers were coated on opposite sides of the support over the cross-over reducing layers. Both emulsions were green-sensitized high aspect ratio tabular grain silver bromide emulsions, where the term "high aspect ratio" is employed as defined by Abbott et al. U.S. Pat. No. 4,425,425 to require that at least 50 percent of the total grain projected area be accounted for by tabular grains having a thickness of less than 0.3 μm and having an aspect ratio of greater than 8:1.

The high contrast emulsion exhibited an average grain diameter of 1.7 μm and an average grain thickness of 0.13 m.

The low contrast emulsion was a 1:1:1 (silver ratio) blend of a first emulsion which exhibited an average grain diameter of 3.0 μm and an average grain thickness of 0.13 μm, a second emulsion which exhibited an average grain diameter of 1.2 μm and an average grain thickness of 0.13 μm, and a third emulsion which was the same as the high contrast emulsion above.

Both the high and the low contrast emulsions 5 were spectrally sensitized with 400mg/Ag mole of anhydro-5,5'-dichloro-9-ethyl-3,3'-bis(3-sulfopropyl)oxacarbocyanine hydroxide, followed by 300 mg/Ag mole of potassium iodide. The emulsion layers were each coated with a silver coverage of 2.42 g/m$^2$ and a gelatin coverage of 3.22 g/m$^2$.

Protective gelatin layers were coated over both emulsion layers at 0.69 g/m$^2$ of gelatin. Control Element A contained no dye in the overcoat layer. In Elements B, C, D, E, and F, prepared for comparison, only the protective overcoat layer on the high contrast emulsion side also contained Dye 4 in a series of coverages of 11, 22, 32, 43, and 54 mg/m$^2$, respectively.

In order to achieve the clear detail in both the high density and low density areas of the radiograph, the radiographic element was loaded with the high contrast side in contact with the thinner, highresolution, "slow speed" screen Y and the low contrast side in contact with the thicker, general purpose, "faster" screen Z.

The radiographic element was loaded into a typical reusable, hinged, light-tight cassette used in radiography. The cassette contained the two different fluorescent screens Y and Z mounted on its two sides so that, when closed, the screens were in direct contact with the inserted radiographic element. The film element was loaded into the cassette in a typical darkroom situation used in medical radiography, illuminated only with the dark red safelights commonly employed. The technician, typically removing the film from a light-tight package, is confronted with the problem of knowing which way to load it into the cassette. In the darkroom the two sides of the control element with no dye in the overcoat layer appear identical, barring some special external marking that was indeed required for the control Element A. Elements B through F, with increasing concentration of the dye in the overcoat layer on the high contrast side of the element, appear black, or nearly black on that side, in contrast to the light gray color of the emulsion itself on the reverse side. The sides are distinguishable even at the lowest level of the dye used. The technician was instructed to load the dark side of the element to the "tube side", i.e., the high resolution screen side of the cassette. The outside of the cassette was labelled "tube side" on the side having Screen Y, the high resolution screen, and was positioned in the exposure device nearest the source of the X-radiation.

Screens

Screen Y has a composition and structure corresponding to that of a commercial, high resolution screen. It consists of a terbium activated gadolinium oxysulfide phosphor having a median particle size of 5 mm coated on a blue-tinted clear polyester support in a Permuthane TM polyurethane binder at a total phosphor coverage of 3.4 g/dm$^2$ at a phosphor to binder ratio of 21:1 and containing 0.0015% carbon.

Screen Z has a composition and structure corresponding to that of a commercial, general purpose screen. It consists of a terbium-activated gadolinium oxysulfide phosphor having a median particle size of 7 mm coated on a white pigmented polyester support in a Permuthane TM polyurethane binder at a total phosphor coverage of 7.0 g/dm$^2$ at a phosphor to binder ratio of 15:1.

Exposures

The cassettes containing the radiographic element and fluorescent screens were exposed to 70 Kv X-radiation, using a 3-phase Picker Medical (Model VTX-650) TM X-ray unit containing filtration up to 3 mm of aluminum. Sensitometric gradations in exposure were achieved by using a 21-increment (0.1 log E) aluminum step wedge of varying thickness.

Processing

The films were processed in 90 seconds in a commercially available Kodak RP X-Omat TM (Model 6B) rapid access processor as follows:

| | |
|---|---|
| Development | 20 seconds at 35° C., |
| Fixing | 12 seconds at 35° C., |
| Washing | 8 seconds at 35° C., |
| Drying | 20 seconds at 65° C., |

where the remaining time was taken up in transport between processing steps. The development step employed the following developer:

| | |
|---|---|
| Hydroquinone | 30. g |
| 1-Phenyl-3-pyrazolidone | 1.5 g |
| KOH | 21. g |
| $NaHCO_3$ | 7.5 g |
| $K_2SO_3$ | 44.2 g |
| $Na_2S_2O_5$ | 12.6 g |
| NaBr | 35. g |
| 5-Methylbenzotriazole | 0.06 g |
| Glutaraldehyde | 4.9 g |
| Water to 1 liter at pH 10.0, | |

and the fixing step employs the following fixing composition:

| | |
|---|---|
| Ammonium thiosulfate, 60% | 260. g |
| Sodium bisulfite | 180. g |
| Boric acid | 25. g |
| Acetic acid | 10. g |
| Aluminum sulfate | 8. g |
| Water to 1 liter at pH 3.9–4.5. | |

Sensitometry

Speed. Optical densities are expressed in terms of diffuse density as measured by an X-rite Model 310 TM densitometer, which was calibrated to ANSI standard PH 2.19 and was traceable to a National Bureau of Standards calibration step tablet. The characteristic curve (density vs. log E) was plotted for each radiographic element processed. The average gradient, presented in Table 1 below under the heading Contrast, was determined from the characteristic curve at densities of 0.25 and 2.0 above minimum density.

TABLE 1

| Element | Dye (mg/m²) in overcoat | Relative Log E Speed | Contrast | Gross Fog |
|---|---|---|---|---|
| A | 0 (control) | 100 | 2.60 | .24 |
| B | 11 | 100 | 2.63 | .25 |
| C | 22 | 98 | 2.61 | .23 |
| D | 32 | 99 | 2.67 | .24 |
| E | 43 | 98 | 2.66 | .25 |
| F | 54 | 97 | 2.68 | .25 |

Spectral Sensitivity. Each of the radiographic elements was exposed with the dyed overcoat layer facing a conventional light source in a Horton spectrosensitometer which exposes the element in 10 nm increments of wavelength. The speed from the density vs. Log E curves at each increment is plotted as relative log spectral sensitivity vs. wavelength. The spectral peak of the sensitization for all of Elements A through F was at 550 nm, dropping off sharply to zero on the long wavelength side. The emission spectrum of the terbium activated gadolinium oxysulfide phosphor used in the screens shows its principal sharp peak centering just short of 550 nm, the peak of the spectral sensitization. The 550 nm peak of the relative log spectral sensitivity vs. wavelength for Element A was 2.84; B: 2.83; C: 2.82; D: 2.81; E: 2.80; and F 2.80.

The speed data in Table 1 show very little filtering effect (at most 0.03 log E) of increasing amounts of the red-absorbing dye on the speed of the film when exposed to the light from the fluorescent screens. Similarly there is very little effect from the filter dyes on the spectral sensitivity values above.

The invention has been described in detail, but it will be understood that variations and modifications can be effected within the spirit and scope of the invention.

I claim:

1. A radiographic element comprised of a) a transparent film support;

b) first and second tabular grain silver halide emulsion layer units coated on opposite sides of the film support and spectrally sensitized with at least one dye having an absorption peak in the green portion of the spectrum at 550 nm;

c) means for reducing to less than 10 per cent crossover of electromagnetic radiation of wavelengths longer than 300 nm forming a latent image in the silver halide emulsion layer units;

d) said first and second silver halide emulsion layer units exhibiting significantly different sensitometric characteristics, and e) orienting means for ascertaining which of said first and second emulsion layer units are positioned nearest a source of X-radiation during exposure, CHARACTERIZED IN THAT said orienting means overlies only one of said emulsion layer units and contains a red absorbing, processing solution decolorizable pentamethineoxonol dye having bis(2-pyrazolin-5-one) nuclei substituted with (a) acyl groups in the 3- and 3'-positions, (b) aryl groups in the 1- and 1'-positions, and (c) bearing from 4 to 6 acidic substituents, each of which are capable of forming a monovalent anion provided that at least two of such substituents are other than carboxyl.

2. A radiographic element of claim 1, further characterized in that said orienting means overlies a first silver halide emulsion layer unit which exhibits a significantly higher contrast than the second silver halide layer unit.

3. A radiographic element of claim 2, further characterized in that said first silver halide emulsion layer unit exhibits an average contrast of at least 2.5 and said second silver halide emulsion layer unit exhibits an average contrast of less than 2.0.

4. A radiographic element of claim 1, further characterized in that said orienting means overlies a first silver halide emulsion layer that exhibits a higher speed than said second silver halide emulsion layer unit.

5. A radiographic element of claim 1, further characterized in that said first silver halide emulsion layer unit exhibits a speed at 1.0 above minimum density at least twice that of said second silver halide emulsion layer unit.

6. A radiographic element of claim 1, further characterized in that said orienting means overlies the second silver halide emulsion layer unit, the first silver halide emulsion layer unit exhibiting a significantly higher speed than the second silver halide layer unit.

7. A radiographic element of claim 6, further characterized in that said first silver halide emulsion layer unit exhibits a speed at 1.0 above minimum density at least twice that of said second silver halide emulsion layer unit.

8. A radiographic element of claim 1, further characterized in that the pentamethineoxonol dye has the formula:

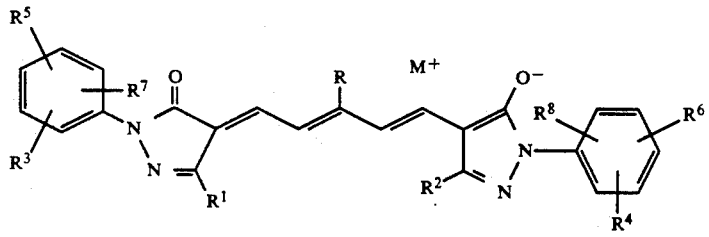

wherein

R is hydrogen or a lower alkyl of up to 4 carbon atoms;

$R^1$ and $R^2$ represent an aliphatic or alicyclic acyl group;

$R^3$, $R^4$, $R^5$, $R^6$, $R^7$, and $R^8$ each represent hydrogen or an acidic substituent capable of forming an anion chosen from the group consisting of carboxyl, sulfo, sulfato, and thiosulfato, provided that a) at least four of $R^3$, $R^4$, $R^5$, $R^6$, $R^7$, and $R^8$ must be acidic substituents and b) at least two of such acidic groups are other than carboxy; and M+ represents hydrogen or a monovalent cation.

9. A radiographic element of claim 8, further characterized in that R is H; $R^1$ and $R^2$ are acetyl or propionyl; $R^3$, $R^4$, $R^5$, and $R^6$ are $SO_3M$; $R^7$ and $R^8$ and H; and M represents hydrogen or a monovalent cation.

10. A radiographic element of claim 1, further characterized in that the pentamethineoxonol dye has the formula:

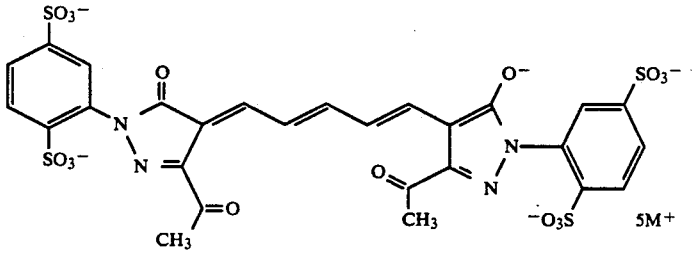

wherein M is H or a monovalent cation.

* * * * *